US011366415B2

(12) United States Patent
Gon

(10) Patent No.: US 11,366,415 B2
(45) Date of Patent: Jun. 21, 2022

(54) FIXING DEVICE AND IMAGE FORMING APPARATUS

(71) Applicant: KYOCERA Document Solutions Inc., Osaka (JP)

(72) Inventor: Shoko Gon, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/262,089

(22) PCT Filed: Jun. 26, 2019

(86) PCT No.: PCT/JP2019/025373
§ 371 (c)(1),
(2) Date: Jan. 21, 2021

(87) PCT Pub. No.: WO2020/021946
PCT Pub. Date: Jan. 30, 2020

(65) Prior Publication Data

US 2021/0294252 A1 Sep. 23, 2021

(30) Foreign Application Priority Data

Jul. 25, 2018 (JP) ..... JP2018-139444

(51) Int. Cl.
*G03G 15/20* (2006.01)

(52) U.S. Cl.
CPC ..... *G03G 15/2053* (2013.01); *G03G 15/20* (2013.01)

(58) Field of Classification Search
CPC ..... G03G 15/2017; G03G 15/2053; G03G 2215/2003
See application file for complete search history.

(56) References Cited

U.S. PATENT DOCUMENTS

| | | | |
|---|---|---|---|
| 9,244,409 B2 | 1/2016 | Kondo | |
| 9,342,044 B2 | 5/2016 | Naitoh et al. | |
| 2013/0195522 A1 | 8/2013 | Kasama | |
| 2016/0223964 A1* | 8/2016 | Ikebuchi | G03G 15/2064 |

FOREIGN PATENT DOCUMENTS

| | | |
|---|---|---|
| JP | 2013-156399 A | 8/2013 |
| JP | 2014-041190 A | 3/2014 |
| JP | 2015-069002 A | 4/2015 |
| JP | 2017-151465 A | 8/2017 |

* cited by examiner

*Primary Examiner* — Thomas S Giampaolo, II
(74) *Attorney, Agent, or Firm* — Studebaker & Brackett PC

(57) ABSTRACT

The fixing device (13) includes the fixing belt (20), the pressuring roller (21) and the pad (24). The pad (24) sandwiches the belt (20) with the roller (21) to form the fixing nip. The pad (24) is extended in the nip width direction, and the pressing face (40) has the first and second curved faces (41) and (42) at upstream and downstream sides in the sheet conveyance direction. The first and second curved faces (41) and (42) are formed arch-like curved to the roller (21) toward upstream and downstream sides. The first and second curved faces (41) and (42) continue at the inflection point (B) near the intersection point of the extending line (A) parallel to the pressuring direction and through the rotation center of the roller (21) on the pressing face (40). The first curved face (41) has the curvature radius (Ra) larger than the second curved face (42).

5 Claims, 6 Drawing Sheets

Related Art

Related Art

FIXING DEVICE AND IMAGE FORMING APPARATUS

TECHNICAL FIELD

The present invention relates to a fixing device fixing a toner image on a sheet and an image forming apparatus including this fixing device.

BACKGROUND ART

An image forming apparatus includes a fixing device fixing a toner image formed on a sheet. The fixing device includes a fixing member heating the toner image formed on the sheet and the pressuring member pressuring the toner image to the sheet. In order to reduce heat capacity of the fixing member and to shorten warm-up time of the fixing member, the fixing device applies, for example, a fixing belt as the fixing member, and the fixing belt is heated by a heat source, such as an IH unit. Inside the fixing belt, a nip forming member, such as a pad, is arranged to sandwich the fixing belt with the pressuring member and to form a fixing nip between the fixing belt and the pressuring member.

For example, a fixing device of Patent Document 1 includes a heat conducting member, which is fastened at an inner circumferential face of a fixing belt to support the fixing belt, heats the fixing belt with heating by a heat source and has an opening at a position facing to a pressuring roller (a pressuring member), and a member (nip forming member), is provided at the opening of the heat conducting member and is pressured to the pressuring roller via the fixing belt.

Moreover, a fixing device of Patent Document 2 includes an endless fixing belt, a heat generating body (a heat source) arranged inside the fixing belt, a nipping member arranged at an interval from the heat generating body and a backup member (a pressuring member) sandwiching the fixing belt with the nipping member to form a nip part between the backup member and fixing belt. The nipping member has a protruding part protruding to a side of the backup member at a downstream side or an upstream side in a rotation direction of the fixing belt.

PRIOR ART DOCUMENT

Patent Document

[Patent Document 1] Japanese patent laid-open publication No. 2014-41190

[Patent Document 2] Japanese patent laid-open publication No. 2015-69002

SUMMARY OF INVENTION

Technical Problem

In the fixing device, on the basis of a shape of a pressing face of the nip forming member at a side of the fixing belt, a fixing face of the fixing belt facing to the pressuring member is formed. In order not to interfere with conveyance of the sheet, for example, as Patent Document 1, the pressing face of the nip forming member may be formed in parallel to a conveyance direction of the sheet inserted to the fixing device, and the fixing face of the fixing belt may be formed in a planar shape. However, because the pressuring member is formed in a cylindrical shape, a contact area of the pressuring member to the planar fixing face of the fixing belt is small and a width of the nip becomes short. Incidentally, because the planar fixing face of the fixing belt makes the sheet with the fixed toner image discharge linearly, the sheet is hardly separated from the fixing belt.

Moreover, the nip forming member may form a curved face in the fixing face of the fixing belt, as Patent Document 2, by arranging the protruding part or the like at the downstream side or the upstream side in the rotation direction of the fixing belt. However, in such a case, because an inflection point of the curved face of the fixing face is recessed from the periphery thereof, pressuring force of the pressuring member insufficiently reaches the inflection point and depressurization of the fixing nip is caused. When the sheet with the formed toner image is conveyed on the fixing face, at a position where depressurization is caused, it is feared that the sheet is slightly slipped and deterioration of image quality, such as image deviation, is caused. Moreover, on the fixing face, at the upstream side in the rotation direction of the fixing belt, the toner on the sheet is insufficiently melted and exists in a granular shape. Therefore, in a case where the inflection point is at the upstream side in the rotation direction of the fixing belt, if depressurization is caused, because the granular toner is easily moved, slight image deviation is easily caused.

Further, the nip forming member may be formed in a circular arc shape of a single curved line curved with a single curvature radius along an outer circumferential face of the pressuring member, in such a case, the fixing belt is formed in a circular arc shape of a single curved line and the fixing nip is also formed in a circular arc shape of a single curved line. With regard to the fixing nip of the single curved line, a plain paper is easily deformed along the fixing belt, but a stiff sheet, such as a cardboard, is hardly deformed along the fixing belt and may not obtain a sufficient nip pressure at an area of the fixing nip depending on a position of the conveyance direction of the sheet.

For example, as shown in FIG. 5, at a position (i.e. a pressure center P0) on an extended line being in parallel to a pressuring direction of pressuring member 101 and passing through a center of the pressuring member 101, even if a stiff sheet S0 is used, a load pressing the sheet S0 to a side of a fixing belt 101 (a nip forming member 102 of a single curved line) by the pressuring member 101 is easily applied, and as shown in FIG. 6, sufficient nip pressure is obtained. Moreover, the vicinity of an inlet N0*a* or an outlet N0*b* of a fixing nip N0 in a conveyance direction of the sheet S0, that is, the vicinity of an edge 102*a* or 102*b* of the nip forming member 102 becomes a fulcrum in a case where the stiff sheet S0 is pressed in the pressure direction, the load is easily applied because the sheet S0 comes into close contact with the fixing belt 101 and sufficient nip pressure is obtained. However, at a position between the vicinity of an inlet N0*a* or an outlet N0*b* of a fixing nip N0 and the pressure center P0, the stiff sheet S0 is hardly deformed along the fixing belt 101, the load is hardly applied because the sheet does not come into close contact with the fixing belt 101 and sufficient nip pressure is not obtained. Therefore, at such a position, depressurization is caused.

Moreover, at a position between the vicinity of an inlet or an outlet of a circular arc fixing nip and the pressure center, in which the load is hardly applied, in a case where an inflection point caused by the above-mentioned shape of the nip forming member is provided, depressurization is remarkably caused.

Objects of the present invention are to lengthen a nip width of a fixing nip and to improve separability of a sheet, and further, to restrain depressurization.

Solution to Problem

A fixing device in accordance with the present invention includes a rotatably fixing belt, a rotatably pressuring member and a nip forming member. The fixing belt is heated by a heat source to heat a toner image formed on a sheet. The pressuring member is pressured to the fixing belt to pressure the sheet passing between the pressuring member and the fixing belt. The nip forming member is arranged inside the fixing belt and sandwiches the fixing belt together with the pressuring member to form a fixing nip between the fixing belt and the pressuring member. The nip forming member is extended in a nip width direction orthogonal to a pressuring direction and a rotational axis direction of the pressuring member, and a pressing face of the nip forming member at a side of the pressuring member has a first curved face at an upstream side and a second curved face at a downstream side in a conveyance direction of the sheet. The first curved face is formed in an arch shape curved to the side of the pressuring member toward the upstream side in the conveyance direction, and the second curved face is formed in an arch shape curved to the side of the pressuring member toward the downstream side in the conveyance direction. The first curved face and the second curved face continue with each other with providing an inflection point near an intersection point of an extending line being in parallel to the pressuring direction and passing through a rotation center of the pressuring member on the pressing face. The first curved face is formed to have a curvature radius larger than the second curved face.

An image forming apparatus according to the present invention includes the above-stated fixing device.

Advantageous Effects of Invention

According to the present invention, it is possible to lengthen a nip width of a fixing nip and to improve separability of a sheet, and further, to restrain depressurization.

DESCRIPTION OF EMBODIMENTS

Figure 1:
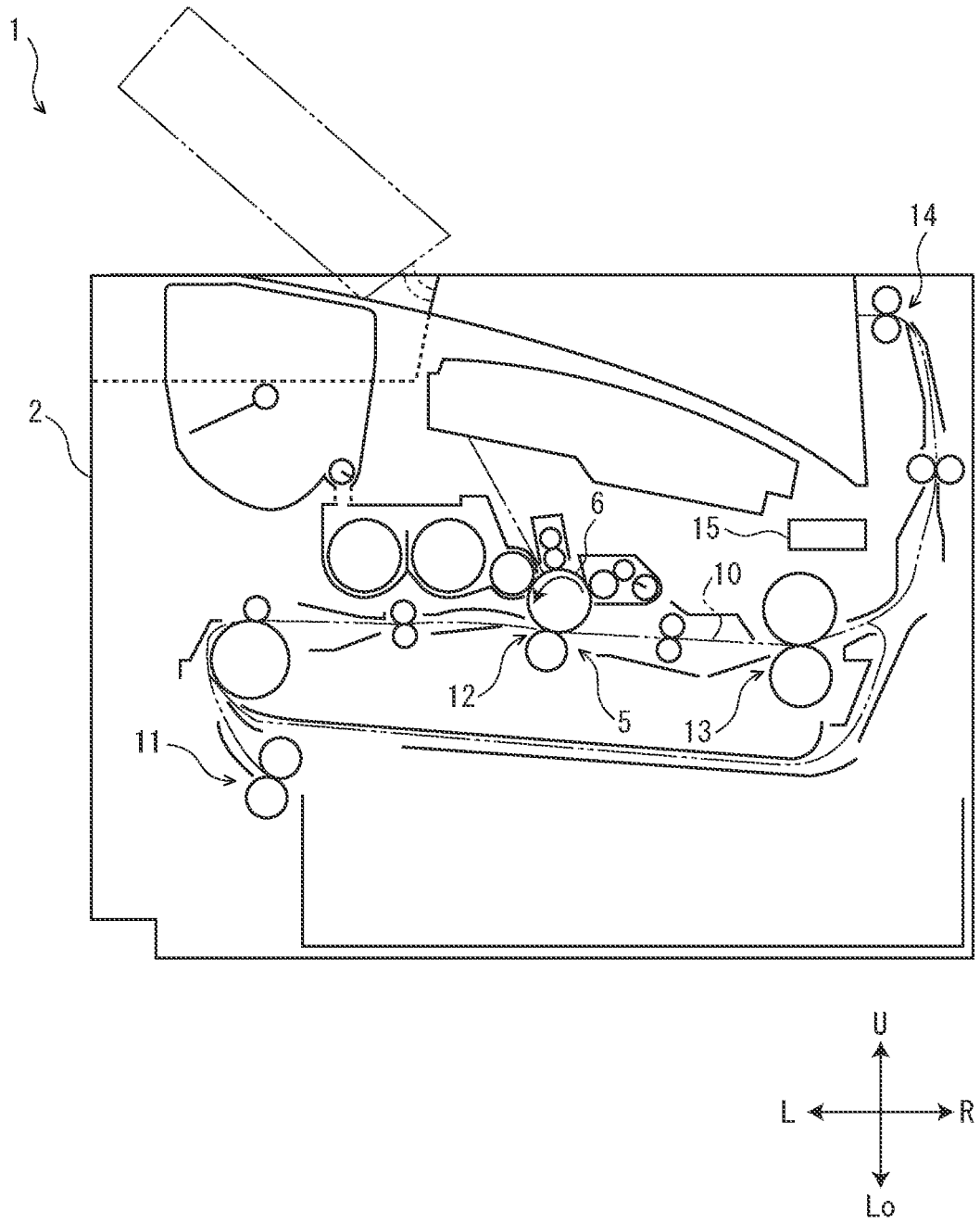
FIG. 1 is a sectional view showing a printer according to an embodiment of the present invention.

First, entire structure of a printer 1 (an image forming apparatus) according to an embodiment of the present invention will be described with reference to FIG. 1. Hereinafter, for convenience of description, it will be described so that the front side of the printer 1 is located at the near side on a paper sheet of FIG. 1. Arrows L, R, U and Lo illustrated in each figure respectively indicate a left side, a right side, an upper side and a lower side of the printer 1.

The color printer 1 includes a roughly box-formed printer body 2, and in a lower part of the printer body 2, a sheet feeding cartridge storing sheets is provided, and in an upper part of the printer body 2, a ejected sheet tray is provided. The printer 1 may include one sheet feeding cartridge in order to store the sheet of a single size and a single kind, or include a plurality of sheet feeding cartridges in order to store the sheets of different sizes (e.g. A4 size, A3 size and others) and different kinds (e.g. a plain paper, a cardboard and others).

In an upper part inside the printer body 2, an exposing device composed of a laser scanning unit (LSU) is provided below of the ejected sheet tray. Below the exposing device inside the printer body 2, an image forming part 5 is provided. In the image forming part 5, a photosensitive drum 6 as an image carrier is rotatably provided, and around the photosensitive drum 6, a charging device, a developing device connected to a toner container, a transferring roller and a cleaning device are arranged along a rotation direction of the photosensitive drum 6.

Inside the printer body 2, a conveying path 10 for the sheet is provided. At an upstream end of the conveying path 10, a sheet feeding part 11 is provided near the sheet feeding cartridge, and at an intermediate stream part of the conveying path 10, a transferring part composed of the photosensitive drum 6 and the transferring roller is provided. At a downstream part of the conveying path 10, a fixing device 13 is provided, and at a downstream end of the conveying path 10, a sheet ejecting part 14 is provided near the ejected sheet tray. Moreover, inside the printer body 2, a controlling device 15 controlling the fixing device 13 is provided. The controlling device 15 is composed of a controlling circuit, such as a CPU, and a storing device, such as a ROM and a RAM.

Next, image forming operation of the printer 1 will be described. When image data is inputted and a printing start is directed from an external computer or the like to the printer 1, the printer 1 starts the image forming operation. At this time, a size and a kind of the sheet as a print object is directed. In the image forming operation, after the charging device of the image forming part 5 electrically charges a surface of the photosensitive drum 6, the exposing device exposes the photosensitive drum 6 with a laser light corresponding to the image data to form an electrostatic latent image on the surface of the photosensitive drum 6. Next, the developing device of the image forming part 5 develops the electrostatic latent image to a toner image by using a toner.

On the other hand, out of the sheets stored in the sheet feeding cartridge, the sheet having the directed size or the directed kind is picked up by the sheet feeding part 11 and conveyed on the conveying path 10. The sheet on the conveying path 10 is conveyed to the transferring part 12 in a given timing, and the toner image on the photosensitive drum 6 is transferred on the sheet. The sheet with the transferred toner image is conveyed to the fixing device 13, and the toner image is fixed on the sheet by the fixing device 13. The sheet with the fixed toner image is ejected from the sheet ejecting part 14 to the ejected sheet tray.

Figure 2:
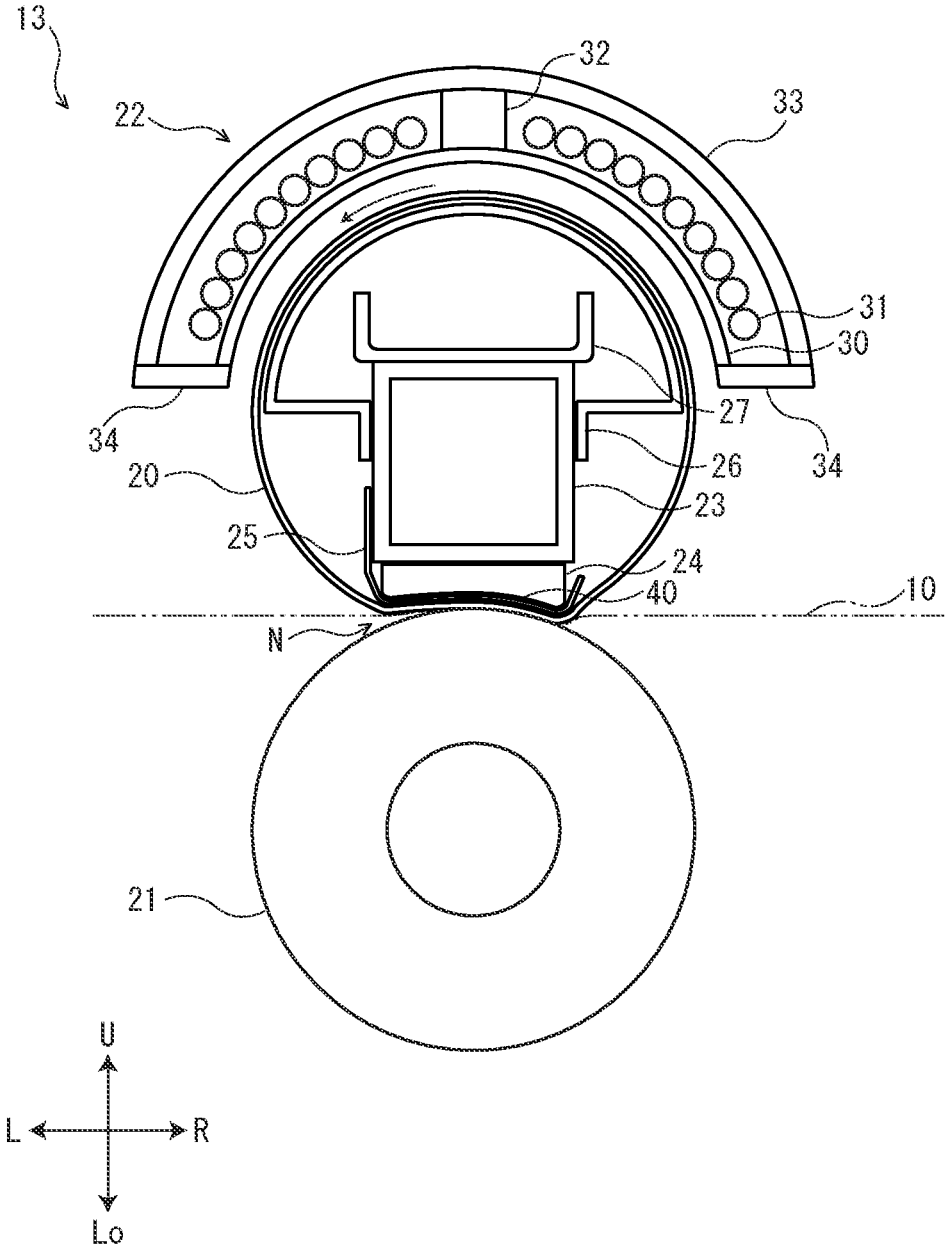
FIG. 2 is a sectional view showing a fixing device according to the embodiment of the present invention.

Next, the fixing device 13 will be described with reference to FIGS. 2-4. As shown in FIG. 2, the fixing device 13 includes a fixing belt 20, a pressuring roller 21 (a pressuring member), a heat source 22, a supporting member 23, a pad 24 (a nip forming member), a sliding sheet 25, a belt guide 26 and an electric component holder 27. Incidentally, in FIG.

3, for convenience of description, the supporting member 23 and the sliding sheet 25 are omitted.

The fixing belt 20 and the pressuring roller 21 are located at an upper side and a lower side across the conveying path 10 inside a roughly box-formed fixing frame (not shown), and arranged to face to each other and to come into contact with each other. The fixing frame is attached to the printer body 2 so that the conveying path 10 penetrates the fixing frame in a conveyance direction (left and right directions) of the sheet. In the conveying path 10, a fixing nip N having a predetermined pressure area is formed between the fixing belt 20 and a pressuring roller 21.

Incidentally, the pressure area is an area where the fixing belt 20 and the pressuring roller 21 come into contact with each other, and indicates from an upstream side position in the conveyance direction, in which pressure to the sheet by the fixing belt 20 and the pressuring roller 21 is 0 Pa, to a downstream side position in the conveyance direction, in which the pressure becomes 0 Pa again after the pressure passed through a position of pressure maximum in the conveyance direction, to the sheet by the fixing belt 20 and the pressuring roller 21 is 0 Pa.

The fixing belt 20 is an endless belt having flexibility, and is long in a width direction (forward and backward direction) of the sheet orthogonal (intersecting) to the conveyance direction of the sheet, and is formed in a cylindrical shape with an outer diameter of 30 mm. The fixing belt 20 is composed of, for example, a heating layer, an elastic layer provided around the heating layer and a releasing layer covering the elastic layer. For example, the heating layer is made of metal material, such as electroformed nickel, with a thickness of appropriately 30-50 μm, the elastic layer is made of elastic material, such as silicone rubber, with a thickness of appropriately 30-50 μm, and the releasing layer is made of fruorine resin material, such as PFA. Incidentally, on an inner circumference face of the fixing belt 20, heat resistant resin coat, such as PTFE, is applied.

The fixing belt 20 is attached so as to rotate with regard to the fixing frame in a rotational axis direction being the forward and backward direction, and is rotated following rotation of the pressuring roller 21. The lower side (a side of the pad 24) of the fixing belt 20 is formed according to a shape of the pad 24. The fixing belt 20 is induction-heated by the heat source 22, for example, the heating layer is heated by a magnetic flux generated by the heat source 22 and comes into contact with the sheet with the formed toner image to heat the toner image.

The pressuring roller 21 is long in the width direction of the sheet, and is formed in a cylindrical shape with an outer diameter of 30 mm. The pressuring roller 21 is composed of, for example, a columnar core material made of metal and an elastic layer with a thickness of appropriately 5 mm made of resin, such as silicone rubber and provided around the core material, and the elastic layer is coated by a releasing layer of fruorine resin, such as PFA.

The pressuring roller 21 is attached so as to rotate with regard to the fixing frame in a rotational axis direction being the forward and backward direction. For example, the core material of the pressuring roller 21 is connected to a drive source (not shown), such as a motor, and is rotated by rotation driving force transmitted from the drive source, and thereby, the pressuring roller 21 is rotated. Moreover, the pressuring roller 21 is pressured to a side of the fixing belt 20 to form the fixing nip N between the fixing belt 20 and the pressuring roller 21, and pressures the sheet passing through the fixing nip N together with the fixing belt 20. The pressuring roller 21 is configured, for example, so as to apply pressure pressuring force of 300-400N to the fixing belt 20.

The heat source 22 is long in the rotational axis direction of the fixing belt 20, is formed to have an arch shape section so as to cover the fixing belt 20, and is located outside (at an upper side of) the fixing belt 20. In other words, the heat source 22 is located at an opposite side to the pressuring roller 21 across the fixing belt 20 at a predetermined interval from the fixing belt 20.

The heat source 22 is, as one example, an IH unit induction-heating the fixing belt 20. The IH unit includes a bobbin 30, a coil 31, a center core 32, a arch core 33 and two rows of side cores 34. The IH unit flows electric current to the coil to generate the magnetic flux and applies the magnetic flux to the fixing belt 20 to induction-heat the fixing belt 20. When the IH unit is controlled by the controlling device 15 so that electric power is supplied from a power source (not shown) to the IH unit, the electric current is flowed to the coil 31. Incidentally, the controlling device 15 controls supplying of the electric power to the heat source 22 so that surface temperature of the fixing belt 20 sensed by a temperature sensor (not shown) becomes a predetermined fixing temperature.

The bobbin 30 is a plate member having an arch shape section along a curved shape (at an upper side of an outer circumference face) of the fixing belt 20, and is located at an upper side of the fixing belt 20. The coil 31 is reciprocated in the rotational axis direction of the fixing belt 20 and is wound around an outer circumference face of the bobbin 30, and is formed so as to be along the outer circumference face of the fixing belt 20. Moreover, the coil 31 is, above-described, an IH coil generating the magnetic flux by the flowed electric current.

The center core 32, the arch core 33 and the two rows of side cores 34 compose a ferrite member guiding the magnetic flux generated by the coil 31. Incidentally, the bobbin 30, the center core 32, the arch core 33 and the two rows of side cores 34 are also used as a case storing the coil 31.

The center core 32 is a formed in a rectangle columnar shape, and is located at a center in the left and right directions on an outer circumference face of the bobbin 30. The arch core 33 is a plate member having an arch shape section with an outer diameter larger than the bobbin 30, and is located at an opposite side to the bobbin 30 across the coil 31. Incidentally, the bobbin 30 and the arch core 33 are arranged so as to be coaxial to the fixing belt 20. The two rows of side cores 34 are formed in plate shapes, and are located at both ends in a circumferential direction of the bobbin 30 and the arch core 33 so as to shut a gap between the bobbin 30 and the arch core 33.

The supporting member 23 is made of, for example, metal material and is formed in a rectangle cylindrical shape longer in the forward and backward directions than the fixing belt 20, and is located at a roughly center inside the fixing belt 20. Both ends in the forward and backward directions of the supporting member 23 are supported by the fixing frame. The supporting member 23 supports the fixing belt 20 and components inside the fixing belt 20, and is formed with material and shape being strong in mechanical strength in order to receive pressuring force from the pressuring roller 21.

The pad 24 is made of, for example, heat resistant resin, such as LCU, and is a long member having a longitudinal direction being the rotational axis direction of the fixing belt 20 and a lateral direction being a nip width direction orthogonal (intersecting) to the rotational axis direction, and is extended in the lateral direction in order to enlarge the fixing nip N. The pad 24 is attached to the supporting member 23 at a side of the pressuring roller 21 (a lower side) from the supporting member 23 inside the fixing belt 20.

Moreover, the pad 24 is arranged so that a face at the side of the pressuring roller 21, i.e. a pressing face 40 comes into contact with the inner circumference face of the fixing belt 20 via the sliding sheet 25. Subsequently, the pad 24 receives the pressuring force from the pressuring roller 21 via the fixing belt 20 to press the pressuring roller 21 via the fixing belt 20 against the pressuring force. Thereby, the pad 24 sandwiches the fixing belt 20 together with the pressuring roller 21 to form the fixing belt 20 between the fixing belt 20 and the pressuring roller 21.

Figure 3:
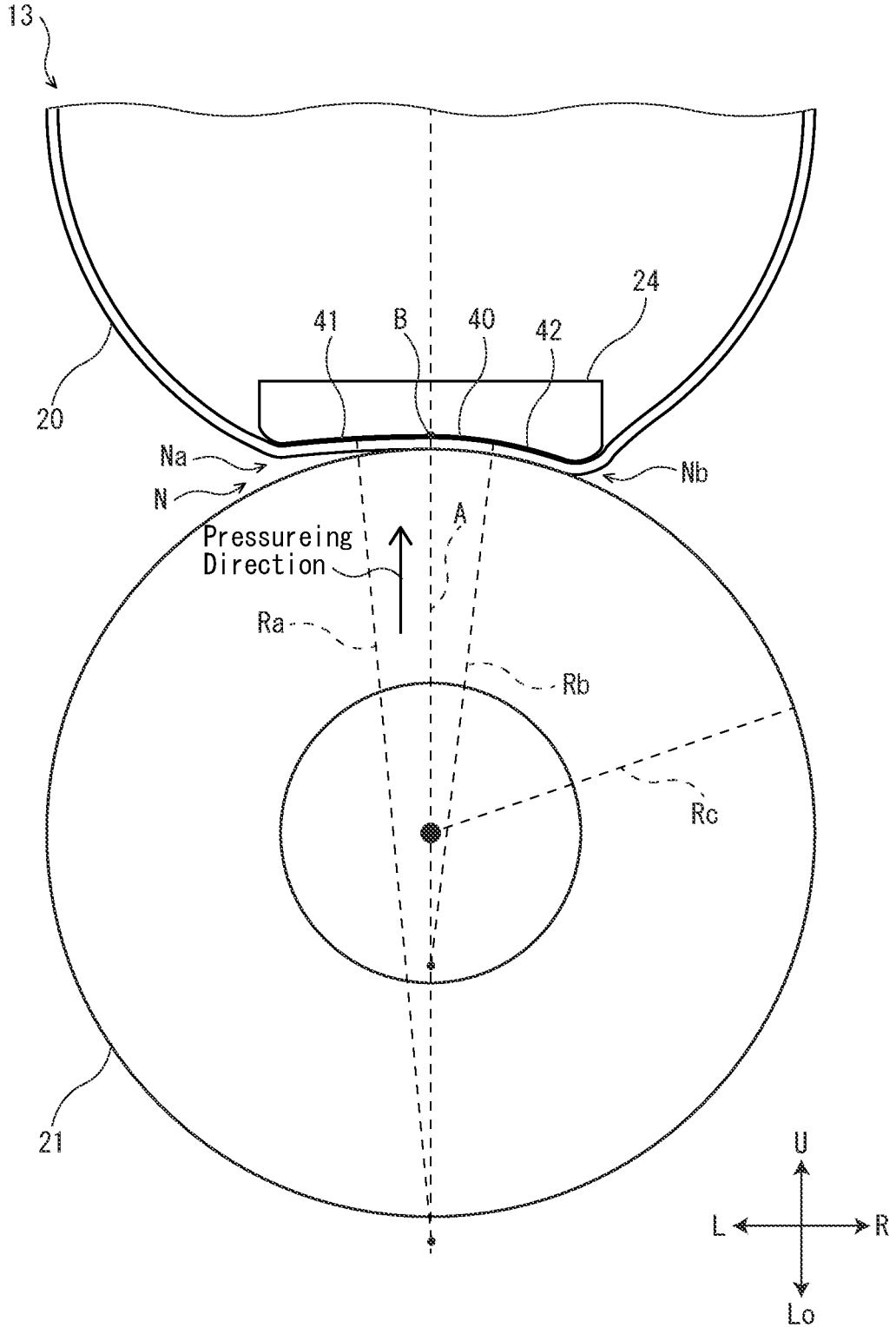
FIG. 3 is a sectional view showing a pad and its periphery of the fixing device according to the embodiment of the present invention.

As shown in FIG. 3, in the present embodiment, a pressuring direction of the pressuring roller 21 to the pad 24 is a direction directing from a rotation center of the pressuring roller 21 to a rotation center of the fixing belt 20, i.e, the upward direction. Moreover, an extending direction (the nip width direction) of the fixing nip N along the pad 24 is a direction orthogonal (intersecting) to the pressuring direction and the rotational axis direction of the pressuring roller 21, i.e. the left and right directions. For example, the pad 24 is arranged so that the center of the pad 24 in the nip width direction is positioned on an extending line A being in parallel to the pressuring direction of the pressuring roller 21 and passing through the rotation center of the pressuring roller 21. Incidentally, since contact areas of the fixing belt 20 deformed along the pad 24 and the pressuring roller 21 become shapes deformed along the pad 24 in fact, the fixing nip N are extended in the left and right direction, but the contact areas may be not in parallel to the left and right directions.

The pressing face 40 of the pad 24 at the side of the pressuring roller 21 has a first curved face 41 at an upstream side (an inlet side of the fixing nip N) and a second curved face 42 at a downstream side (an outlet side of the fixing nip N) in the conveyance direction of the sheet. The first curved face 41 is formed to have an arch shape section curved at the side of the pressuring roller 21 toward the upstream side in the conveyance direction, and the second curved face 42 is formed to have an arch shape section curved at the side of the pressuring roller 21 toward the downstream side in the conveyance direction.

The first curved face 41 and the second curved face 42 continue with each other with providing an inflection point B near an intersection point of the above-described extending line A on the pressing face 40, and the pad 24 has a section shape recessed upwardly. In other words, the section shape of the pad 24 is a compound curved line shape in which the pressing face 40 with regard to the fixing nip N is composed of a plurality of curved lines. Incidentally, the inflection point B of the first curved face 41 and the second curved face 42 may be arranged at a pressure center where the pressing face 40 and the extending line A are intersected, or may be arranged within a range of appropriately ±1 mm from the extending line A in the conveyance direction of the sheet, for example, may be preferably arranged at a position shifted by appropriately 0.5 mm to the downstream side in the conveyance direction under distribution of nip pressure or image quality.

Moreover, the pressing face of the pad 24 is formed so that a first curvature radius Ra (curvature radius) of the first curved face 41 and a second curvature radius Rb of the second curved face 42 are larger than a radius Rp of the pressuring roller 21 and the first curvature radius Ra of the first curved face 41 is larger than the second curvature radius Rb of the second curved face 42. In other words, a center point composing the arch shape of the second curved face 42 is arranged at a lower side from a center point of the pressuring roller 21, and a center point composing the arch shape of the first curved face 41 is arranged at a lower side from the center point of the second curved face 42.

For example, with regard to the fixing belt 20 of the outer diameter 30 mm and the pressuring roller 21 of the outer diameter 30 mm, the first curved face 41 is preferably formed with the first curvature radius Ra of 80 mm or more, and the second curved face 42 is preferably formed with the second curvature radius Rb of 40 mm or more. Further, the pressing face 40 is preferably formed so that the second curvature radius Rb of the second curved face 42 is larger than twice of the radius Rp of the pressuring roller 21. Incidentally, in the present embodiment, it is described as an example that the first curvature radius Ra is appropriately twice the second curvature radius Rb, but the first curvature radius Ra may be slightly larger than the second curvature radius Rb. Moreover, the first curved face 41 may be formed in a parallel straight line to the nip width direction, and in this case, the first curvature radius Ra of the first curved face 41 is infinite.

The sliding sheet 25 is made of material having flexibility, heat resistance, slidability, durability and others, is attached to the supporting member 23, and is interposed between the inner circumference face of the fixing belt 20 and the pad 24. The sliding sheet 25 directly comes into contact with the inner circumference face of the fixing belt 20 to reduce sliding resistance of the fixing belt 20 and the pad 24 and to secure sliding performance of the fixing belt 20. In order to improve the slidability, to the sliding sheet 25, lubricant, such as an oil, is applied. The sliding sheet 25 also restrains frictional wear of the fixing belt 20 and the pad 24.

The belt guide 26 is made of a magnetic SUS (stainless steel) plate or the like with a thickness of 0.2-0.3 mm and is formed in an arch shape section along an upper side of the inner circumference of the fixing belt 20. The belt guide 26 is located at a position facing to the heat source 22 so that an arch-liked outer circumference face of the belt guide 26 is along the inner circumference of the fixing belt 20, and is attached to the supporting member 23. The belt guide 26 comes into contact with the inner circumference of the fixing belt 20 to assist and to stabilize rotation orbit of the fixing belt 20. Moreover, the belt guide 26 absorbs leaked magnetic flux penetrated the fixing belt 20 to assist heat generation and to reduce leaked magnetic flux to the inside the fixing belt 20.

The electric component holder 27 is a member to which electric components, such as a temperature sensor, arranged inside the fixing belt 20 are attached, and is attached to the supporting member 23 inside the fixing belt 20.

In accordance with the present embodiment, as described above, the fixing device 13 of the printer 1 (the image forming apparatus) includes the rotatably fixing belt 20 heated by the heat source 22 to heat the toner image formed on the sheet, the rotatably pressuring roller 21 (the pressuring member) pressured to the fixing belt 20 to pressure the sheet passing between the pressuring roller 21 and the fixing belt 20, and the pad 24 (the nip forming member) arranged inside the fixing belt 20 and sandwiching the fixing belt 20 together with the pressuring roller 21 to form the fixing nip N between the fixing belt 20 and the pressuring roller 21. The pad 24 is extended in the nip width direction orthogonal to the pressuring direction and the rotational axis direction of the pressuring roller 21, and the pressing face 40 of the pad 24 at the side of the pressuring roller 21 has the first curved face 41 at the upstream side and the second curved face 42 at the downstream side in the conveyance direction of the sheet. The first curved face 41 is formed in an arch shape curved to the side of the pressuring roller 21 toward the upstream side in the conveyance direction, and the second curved face 42 is formed in an arch shape curved to the side of the pressuring roller 21 toward the downstream side in the conveyance direction. The first curved face 41 and the second curved face 42 continue with each other with providing the inflection point B near the intersection point of the extending line A being in parallel to the pressuring direction of the pressuring roller 21 and passing through the rotation center of the pressuring roller 21 on the pressing face 40. The first curved face 41 is formed to have the first curvature radius Ra larger than the second curved face 42.

Since the fixing device 13 adopts the fixing belt 20 as the fixing member, it is possible to reduce heat capacity and to shorten warm-up time. Moreover, the pad 24 is extended in the nip width direction, and the pressing face 40 of the pad 24 is formed to be convex shape in the pressuring direction and to curve to the side of the pressuring roller 21 at the upstream side and the downstream side in the conveyance direction of the sheet. Therefore, it is possible to form the fixing nip N in large (wide), and to improve separability of the sheet, that is discharged from the fixing nip N, from the fixing belt 20.

Further, in the pad 24, the inflection point B of the first curved face 41 and the second curved face 42 of the pressing face 40 is arranged near the pressure center of the pressuring roller 21. Therefore, it is possible to restrain malfunction caused in a case where depressurization is caused by providing the inflection point B at the upstream side or the downstream side from the pressure center the pressuring roller 21, e.g. deterioration of image quality, such as image deviation, caused by slight slipping of the sheet due to depressurization or slight image deviation caused by moving of the granular toner due to depressurization.

Figure 4:
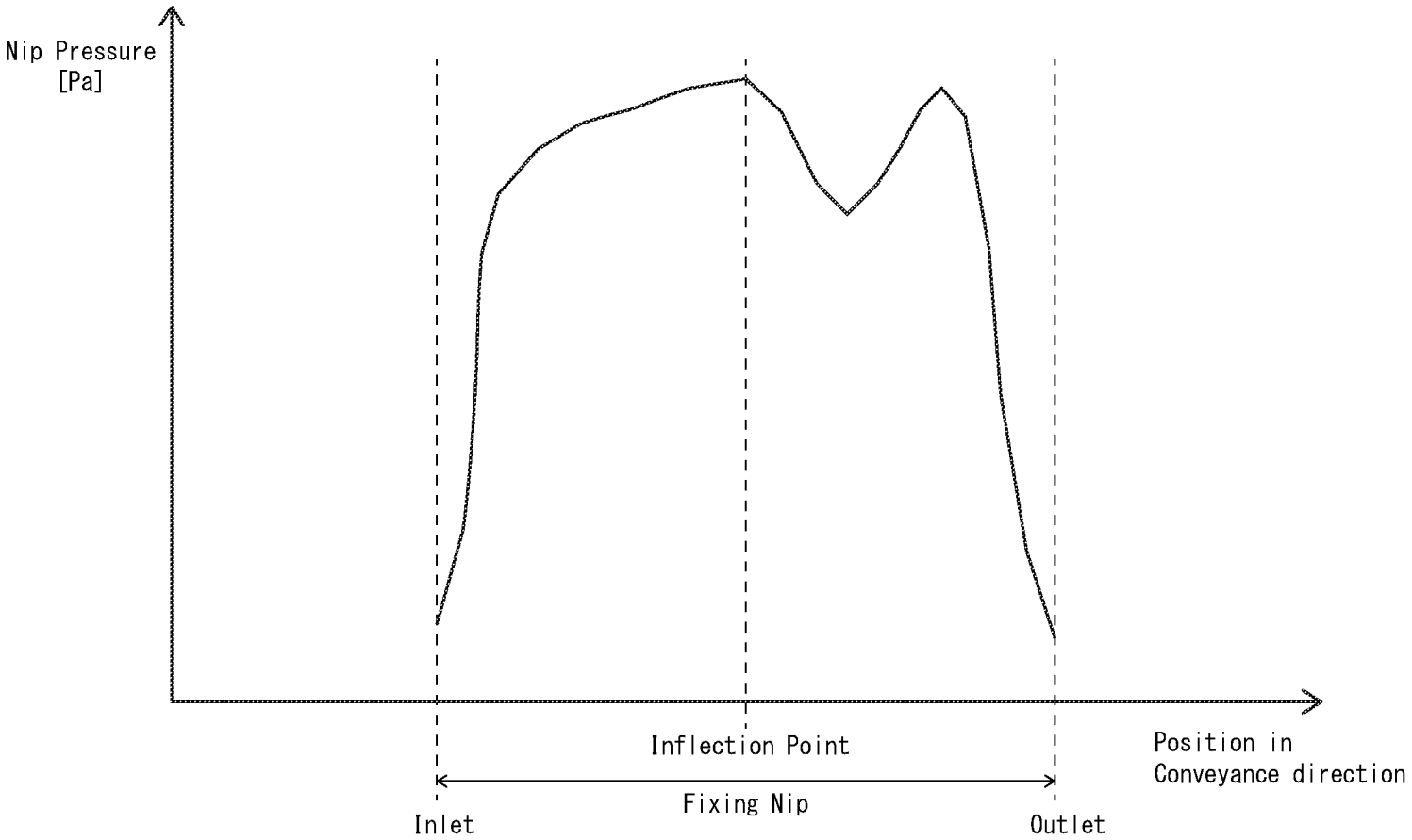
FIG. 4 is a graph plotting nip pressures depending on positions in a conveyance direction in a case where a sheet is passed through a fixing nip in the fixing device according to the embodiment of the present invention.
Figure 5:
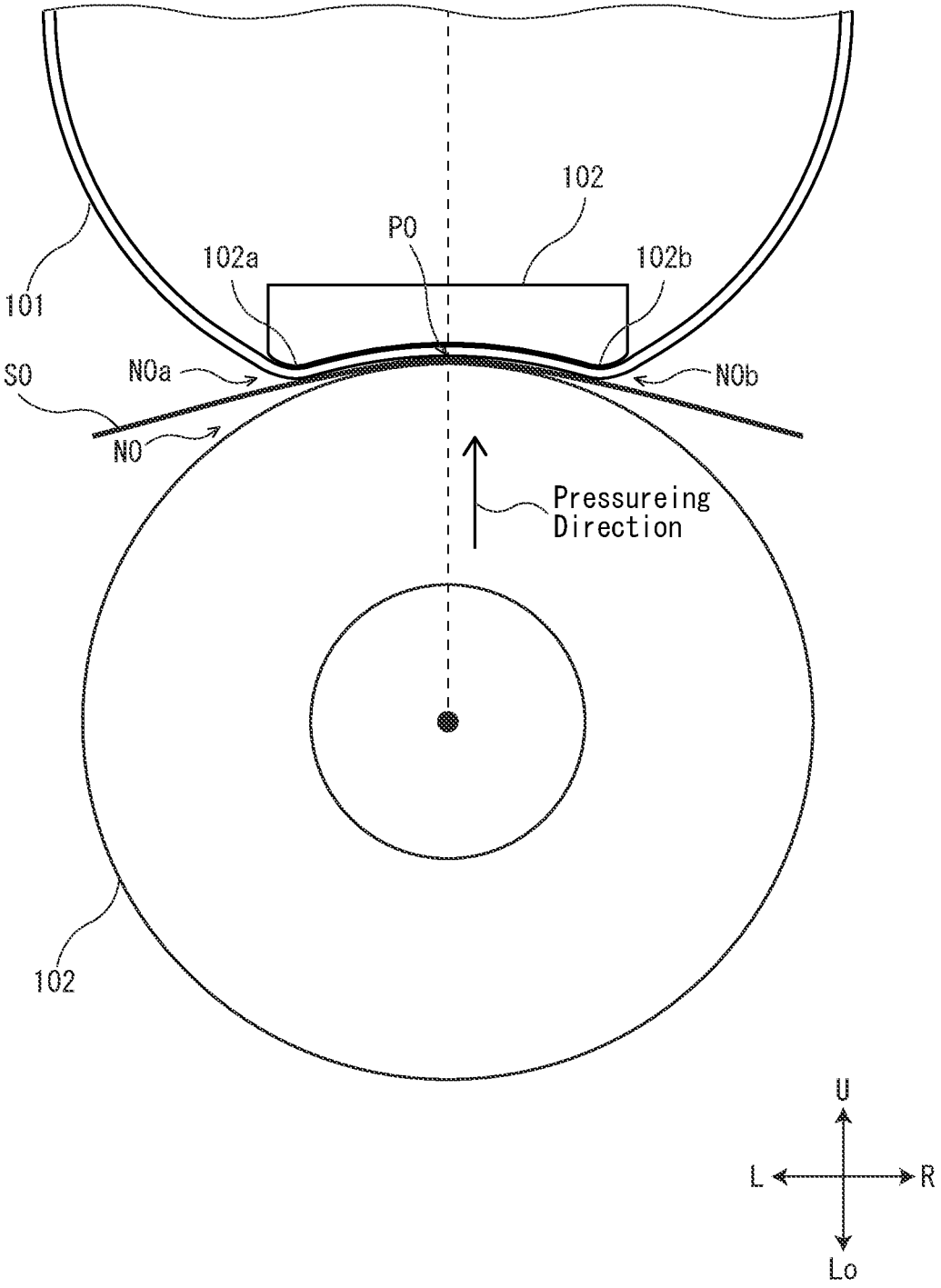
FIG. 5 is a sectional view showing a nip forming member and its periphery of a fixing device of a related art.
Figure 6:
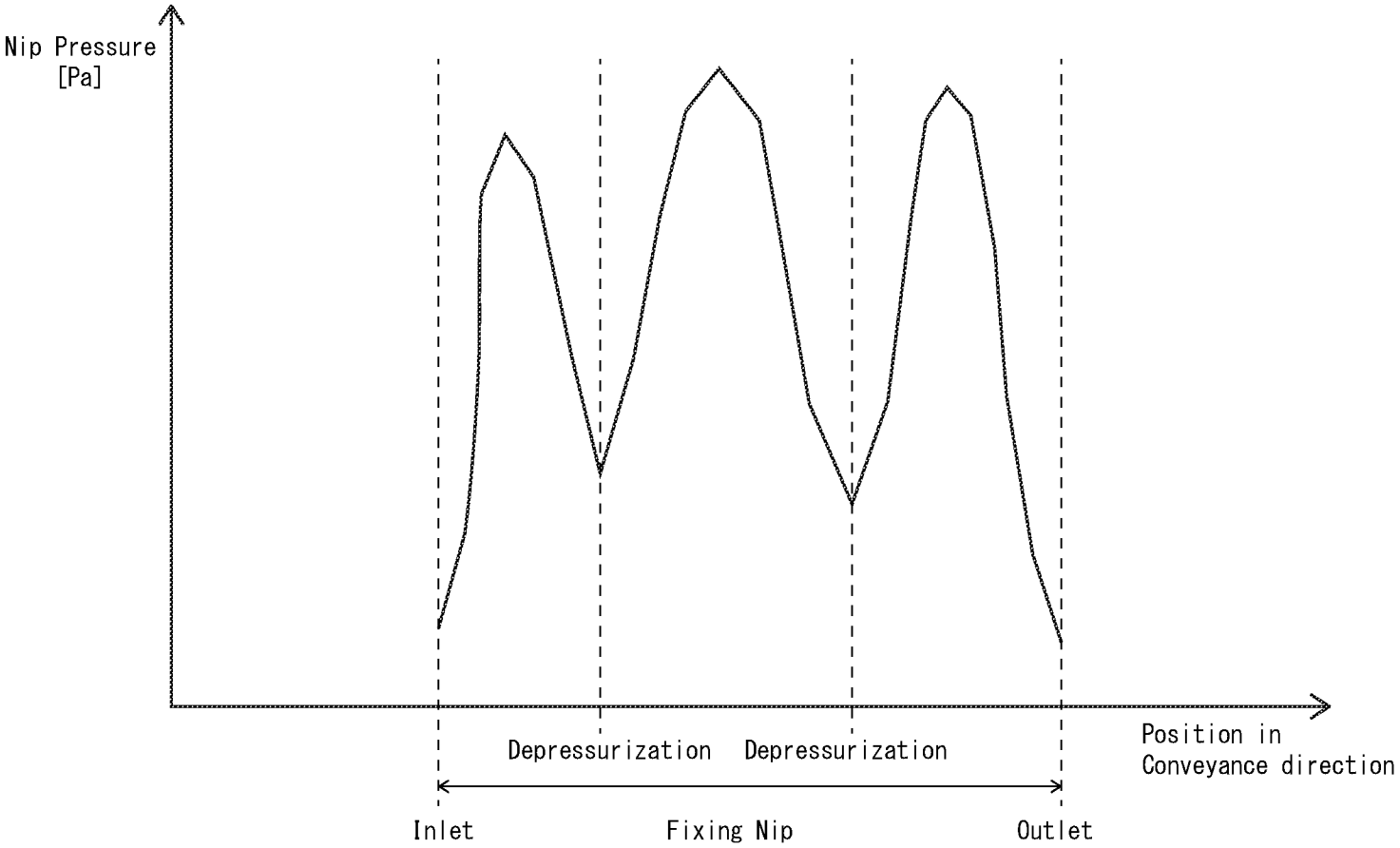
FIG. 6 is a graph plotting nip pressures depending on positions in a conveyance direction in a case where a cardboard is passed through a fixing nip in the fixing device of the related art.

For example, FIG. 4 is a graph plotting nip pressures obtained depending on positions in the conveyance direction of the sheet in the pressure area of the fixing nip N in a case where the fixing device 13 of the present embodiment carries out fixing process to the sheet. As shown in FIG. 4, neat the pressure center of the pressuring roller 21, since a load pressing the sheet to the side of the fixing belt 20 (the pad 24) is easily applied and sufficient nip pressure is obtained, it is possible to restrain causing of depressurization.

Moreover, in the pressing face 40 of the pad 24, the first curved face 41 is formed with the first curvature radius Ra larger than the second curved face 42. Therefore, it is possible to restrain deviation of the sheet in an insertion direction to the fixing nip N with regard to the conveyance direction to the fixing device 13, and to restrain stress affected by the fixing belt 20 when the sheet is inserted into the fixing nip N, and to stabilize behavior of the sheet when insertion. In addition, by enlarging the first curvature radius Ra of the first curved face 41, it is possible to improve contact performance of the sheet to the fixing belt 20 at the inflection point B and to further restrain depressurization.

Further, since the first curvature radius Ra of the first curved face 41 is relatively large, in a case where a stiff sheet, such as a cardboard is passed through the fixing nip N, it is possible to obtain sufficient nip pressure even between the vicinity of the inlet and the pressure center of the fixing nip N by applying a load from the pressuring roller 21, and to restrain depressurization. Moreover, between the vicinity of the outlet and the pressure center of the fixing nip N, although the second curvature radius Rb of the second curved face 42 is relatively small, since the first curvature radius Ra of the first curved face 41 at the upstream side in the conveyance direction is large, an insertion angle of the sheet to the second curved face 42 becomes gentle and arranging of the sheet along the second curved face 42 becomes easy, and therefore, in a case where the stiff sheet, such as the cardboard is passed through the fixing nip N, it is possible to obtain sufficient nip pressure by applying a load from the pressuring roller 21, and to reduce depressurization. Incidentally, at the downstream side from the pressure center of the nixing nip N, since the toner is heated and melt from granule, when the nip pressure is a half or more of a peak in the vicinity of the pressure center, even if small depressurization is caused, it is possible to restrain image deviation.

Moreover, in the fixing device 13 of the present embodiment, the pad 24 may be preferably configured so that the second curvature radius Rb of the second curved face 42 is larger than twice the radius Rp of the pressuring roller 21. Thereby, it is possible to further restrain depressurization at the inflection point B and the second curved face 42 and to further improve the separability of the sheet, that is discharged from the fixing nip N, from the fixing belt 20.

Incidentally, in the above-described embodiment, an example that the heat source 22 is composed of the IH unit and is arranged outside the fixing belt 20 was described, but the present invention is not restricted by this example, for example, in another embodiment, the heat source 22 may be composed of a halogen heater, a ceramic heater or the like and may be arranged outside or inside the fixing belt 20.

Although the present embodiment is was described about a case where structure of the present invention is applied to the monochrome printer 1, in another embodiment, the present invention may applied to another image forming apparatus, such as a color printer, a copying machine, a facsimile or a multifunction peripheral.

The above description of the embodiment shows an aspect in the fixing device and the image forming apparatus in accordance with the present invention, and a technical scope of the present invention is not limited to the above-described embodiment.

The invention claimed is:

1. A fixing device comprising:

a rotatable fixing belt heated by a heat source to heat a toner image formed on a sheet;

a rotatable pressuring member pressured to the fixing belt to pressure the sheet passing between the pressuring member and the fixing belt; and a nip forming member arranged inside the fixing belt and sandwiching the fixing belt together with the pressuring member to form a fixing nip between the fixing belt and the pressuring member, wherein the nip forming member is extended in a nip width direction orthogonal to a pressuring direction and a rotational axis direction of the pressuring member, and a pressing face of the nip forming member at a side of the pressuring member has a first curved face at an upstream side and a second curved face at a downstream side in a conveyance direction of the sheet, the first curved face is formed in an arch shape curved to the side of the pressuring member toward the upstream side in the conveyance direction, and the second curved face is formed in an arch shape curved to the side of the pressuring member toward the downstream side in the conveyance direction, the first curved face and the second curved face continue with each other with an inflection point near an intersection point of an extending line being in parallel to the pressuring direction and passing through a rotation center of the pressuring member on the pressing face, the first curved face is formed to have a curvature radius larger than a curvature radius of the second curved face, the nip forming member is configured so that the curvature radius of the second curved face is larger than twice a radius of the pressuring member.

2. The fixing device according to claim 1, wherein the inflection point of the first curved face and the second curved face is arranged at a pressure center, where the pressing face and the extending line are intersected.

3. The fixing device according to claim 1, wherein the inflection point of the first curved face and the second curved face is arranged at a position shifted from a pressure center, where the pressing face and the extending line are intersected, to the downstream side in the conveyance direction.

4. The fixing device according to claim 1, wherein the curvature radius of the first curved face is approximately twice the curvature radius of the second curved face.

5. An image forming apparatus comprising the fixing device according to claim 1.

* * * * *